US006805056B1

(12) United States Patent
Poe

(10) Patent No.: US 6,805,056 B1
(45) Date of Patent: Oct. 19, 2004

(54) METHOD AND APPARATUS FOR REMOVING ABANDONED TUBULAR MEMBERS

(76) Inventor: William T. Poe, P.O. Box 45742, Baton Rouge, LA (US) 70895

( * ) Notice: Subject to any disclaimer, the term of this patent is extended or adjusted under 35 U.S.C. 154(b) by 0 days.

(21) Appl. No.: 10/425,921

(22) Filed: Apr. 29, 2003

(51) Int. Cl.[7] ..... F42B 1/02; F42B 3/00; F42B 4/06; E21B 17/01

(52) U.S. Cl. ..... 102/307; 102/312; 102/313; 102/341; 166/297; 166/55; 166/63; 175/4.52; 175/4.53; 175/4.6

(58) Field of Search ..... 102/307, 312, 102/313, 341, 349, 399; 166/57, 365, 367, 297, 55, 63; 175/4.52, 4.53, 4.6

(56) References Cited

U.S. PATENT DOCUMENTS

| | | | | | |
|---|---|---|---|---|---|
| 2,684,030 | A | * | 7/1954 | Morris | 102/307 |
| 2,761,384 | A | * | 9/1956 | Sweetman | 175/4.6 |
| 4,116,130 | A | * | 9/1978 | Christopher et al. | 102/307 |
| 4,290,486 | A | * | 9/1981 | Regalbuto | 166/297 |
| 4,323,117 | A | | 4/1982 | Pierce | |
| 4,528,910 | A | | 7/1985 | Blanc et al. | |
| 4,787,315 | A | * | 11/1988 | Kenny | 102/313 |
| 4,799,829 | A | | 1/1989 | Kenny | |
| 5,031,540 | A | | 7/1991 | Kenny | |
| 5,177,321 | A | | 1/1993 | Kenny | |
| 5,467,824 | A | | 11/1995 | DeMarsh et al. | |
| 5,477,785 | A | | 12/1995 | Dieman, Jr. et al. | |
| 5,524,546 | A | | 6/1996 | Rozner et al. | |
| 5,525,010 | A | | 6/1996 | Kenny et al. | |
| 5,777,257 | A | * | 7/1998 | Kenny | 102/312 |
| 5,791,821 | A | | 8/1998 | Kiesler | |
| 6,009,811 | A | | 1/2000 | Newman et al. | |
| 6,076,601 | A | * | 6/2000 | Mooney, Jr. | 166/297 |
| 6,131,517 | A | * | 10/2000 | Poe | 102/307 |
| 6,230,627 | B1 | * | 5/2001 | Poe | 102/307 |

* cited by examiner

*Primary Examiner*—Jack W. Keith
*Assistant Examiner*—James S. Bergin
(74) *Attorney, Agent, or Firm*—Garvey, Smith, Nehrbass & Doody, LLC; Charles C. Garvey, Jr.

(57) ABSTRACT

A method and apparatus for removing a tubular member (e.g., leg of an abandoned or obsolete fixed platforms in a marine environment) is provided. The apparatus includes a delivery system having a frame carrying explosive shaped charges. The frame includes charges having curved sections which can be moved relative to one another for engaging the inside bore of a tubular member to be severed. The charges are biased (e.g., spring loaded) to be moved automatically to an extended position that engages the tubular member (e.g., platform leg) when a trigger is activated from a remote location. The trigger can be a pin carried in a tube with wires connecting each curved charge section to the pin. When the pin is lifted from its tube, the wires are released enabling the springs to thrust the charges against the inside of a pipe, leg or tubular member to be cut. Once in this position, the charges can be fired.

20 Claims, 4 Drawing Sheets

METHOD AND APPARATUS FOR REMOVING ABANDONED TUBULAR MEMBERS

CROSS-REFERENCE TO RELATED APPLICATIONS

Not Applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to improved method and apparatus for removing underwater tubular members such as the legs of abandoned marine platform jackets and like fixed platforms. The present invention also relates to the removal of underwater tubular members from a seabed using remote placement of explosive charges and an improved delivery system. Even more particularly, the present invention relates to improved method and apparatus for removing tubular members such as legs of marine jackets and like fixed platforms from the seabed by employing a specially configured delivery system that carries explosive charges that are to be placed inside of the hollow legs (or like tubular member) of an abandoned jacket or fixed platform, (e.g. oil well, oil production platform or the like).

2. General Background of the Invention

In the offshore oil and gas well drilling industry, there are a large number of fixed platforms that have been installed over the years in the fragile marine environment. These platforms typically involve the use of a structural steel frame or "jacket" that is comprised of a plurality of hollow tubular members, many of which are vertically oriented. In order to anchor the jacket to the seabed during installation, elongated hollow piling members are place through the vertical leg portions of the jacket and thrust downwardly into the seabed.

After a number of years of use, these offshore oil and gas well drilling platforms and production platforms can become obsolete. Under relevant laws, they are necessarily removed since they are a hazard to navigation. One of the methods of removing offshore oil and gas well drilling platforms and production platforms requires that the legs of the jacket or platform be severed below (e.g. 15 feet) the mud line. The remaining portion above the cut can be lifted from the seabed using a crane. The jacket or platform can be placed on a barge for later disposal at a suitable scrap yard or like site.

One of the problems that has faced the offshore oil and gas well drilling industry is the removal of obsolete or abandoned platforms without adversely effecting the surrounding marine environment. Typically, offshore marine environments are very delicate and should necessarily be minimally impacted by a method that is used to remove a fixed platform or production platform.

Another problem that faces a salvage company is excess expense and danger if a diver must cut the legs one at a time with an underwater cutting torch.

Prior U.S. Pat. Nos. 6,131,517 and 6,230,627 (each incorporated herein by reference) disclose apparatus and methods for removing abandoned offshore fixed platforms.

BRIEF SUMMARY OF THE INVENTION

The present invention provides an improved delivery system for placing explosives that enable removal of an offshore fixed platform from the marine environment. In such a situation, the platform typically has a plurality of legs that extend below the seabed, each leg or like tubular member being hollow and having a leg wall with an inside surface.

The method of the present invention first lowers the delivery apparatus of the present invention within a leg at a selected locale. A frame supports a plurality of explosive charges. The charges have curved portions that track the curvature of the platform leg at an area to be severed.

The explosive charges carried by the frame are remotely operated to move outwardly and engage the inside wall surface of the leg at a desired location. The wall of the leg is then severed by detonating the explosive charge that are supported with the frame.

These steps are repeated until all of the legs have been severed. The platform is then lifted from the seabed so that it can be placed on a transport barge for disposal at a fabrication yard, salvage yard, or scrap yard.

The present invention provides an improved and remotely operated delivery system for placing explosive charges in a pipe to be severed. The delivery system provides a method of placing an adjustable frame within the leg or pipe to be salvaged at the seabed area, the frame having multiple, curved charge carriers that are automatically movable from a remote locale between retracted and expanded positions.

As part of the method, the frame and its explosive charges are positioned next to the inside wall surface of the leg. The frame is expanded to the expanded position using a trigger mechanism that can be actuated from a location well above the charges.

The frame can be lowered or otherwise remotely delivered to a site that would ordinarily be inaccessible and then "triggered" to thrust each charge against the wall to be severed.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
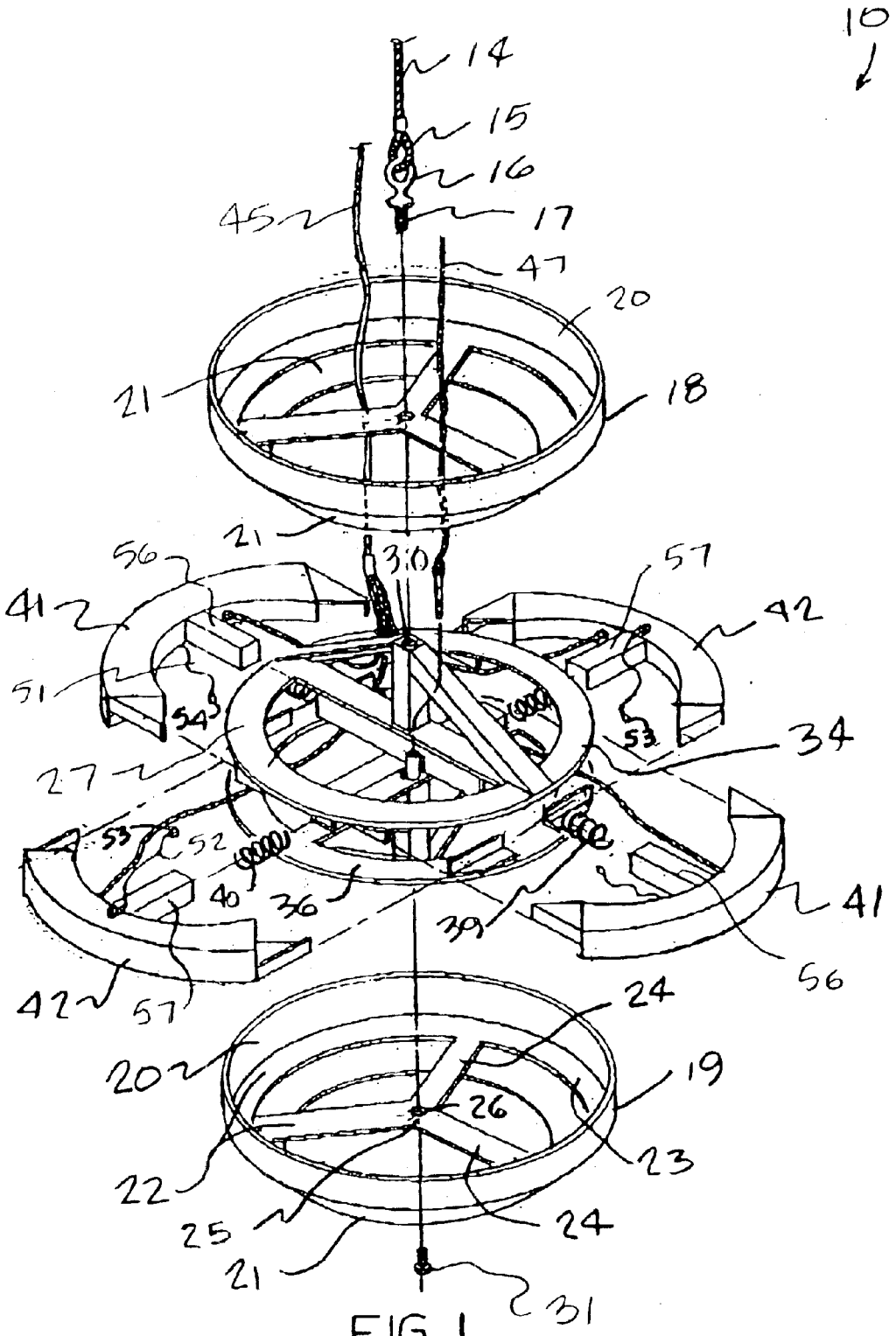
FIG. 1 is an exploded perspective view of the preferred embodiment of the apparatus of the present invention.

In FIGS. 1-5 underwater explosive apparatus 10 can be used to sever a selected tubular member 11 such as a leg of a fixed platform that is to be removed from the seabed. Such fixed platforms can be oil production platforms, oil exploration platforms, piling or other such tubular members that have no longer have any useful purpose.

Such a tubular member 11 has an outer surface 12 and an inner surface 13. The apparatus 10 of the present invention can be lowered into the tubular member 11 using cable 14 and loop 15. The loop 15 supports lifting eye 16 that can have lower external threads that enable it to be attached to frame 27.

When lowering underwater explosive apparatus 10 into tubular member 11, a pair of spacers are provided to keep the apparatus 10 centered within tubular member 11. These can include upper spacer 18 and lower spacer 19.

Each spacer 18, 19 can include a cylindrically shaped portion 20 and a frustoconical section 21. Each spacer 18, 19 also includes a horizontal frame section 22 that includes peripheral circular section 23 and a plurality of radial struts 24 that connect at hub 25. Hub 25 can have an opening 26 that enables lifting loop 15 to extend through it as shown in FIG. 1.

Frame 27 provides a charge carrier support frame that can hold a plurality of charge housings 41,42. The frame 27 includes upper vertical member 28, lower vertical member 29, upper horizontal section 32 and lower horizontal section 33. Internally threaded opening 30 on upper vertical member 28 receives and connects to lifting eye 16 at its external threads 17. Bolt 31 extends through opening 26 of lower spacer 19 and engages a similar internally threaded opening in lower vertical member 29.

Frame 27 includes upper plate 34 and lower plate 36. The upper plate 34 attaches to upper vertical member 28 with upper diagonal braces 35. Similarly, lower plate 36 connects next to lower vertical member 29 using lower diagonal braces 37.

Figure 2:
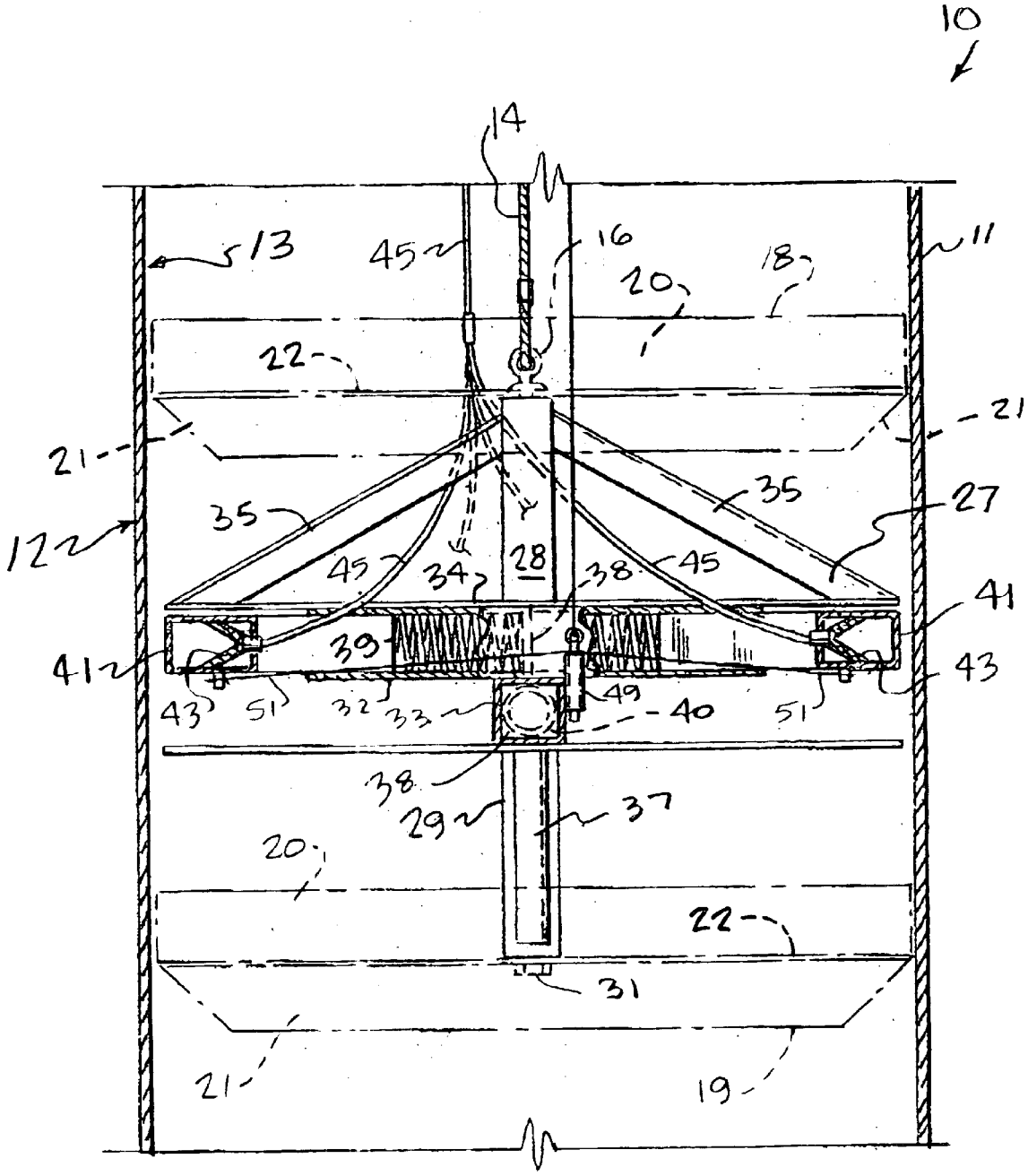
FIG. 2 is a side, partially cut away view of the preferred embodiment of the apparatus of the present invention.

A transverse plate 38 is provided inside of each of the upper and lower horizontal vertical sections 32, 33 as shown in FIG. 2. Plates 38 act as a stop for coil springs 39, 40. Upper horizontal section 32 has transverse stop 38 and a pair of upper coil springs 39 positioned on opposing side respectively of transverse plate 38 as shown in FIG. 2. Similarly, a pair of lower coil springs 40 are provided inside of lower horizontal 33 and on opposing sides of its transverse plate 38.

There are a pair of upper charge housings 41 and a pair of lower charge housings 42 supported upon frame 27. The upper charge housings 41 each have projecting portions 56 that fit inside of upper horizontal section 32. Similarly, charge housings 42 have projecting portions 57 that fit inside of lower horizontal section 33. Each of the charge housings 41, 42 are curved to conform to the inner surface 13 of tubular member 11 to be cut.

Each of the charge housings 41, 42 has an explosive charge 43 that can be fired using booster 44 and detonating cord 45. The detonating cord 45 extends up to the surface area and down to the booster 44 and explosive charge 43. Detonating cord 45 enables the explosive charge 43 to be detonated from a remote location at the surface deck area of a platform having legs (or a leg) to be severed. When fired, charges thrust a explosive cutting jet in the direction of arrow 46 for severing tubular member 11 at a selected location as shown in FIGS. 4 and 5.

Figure 3:
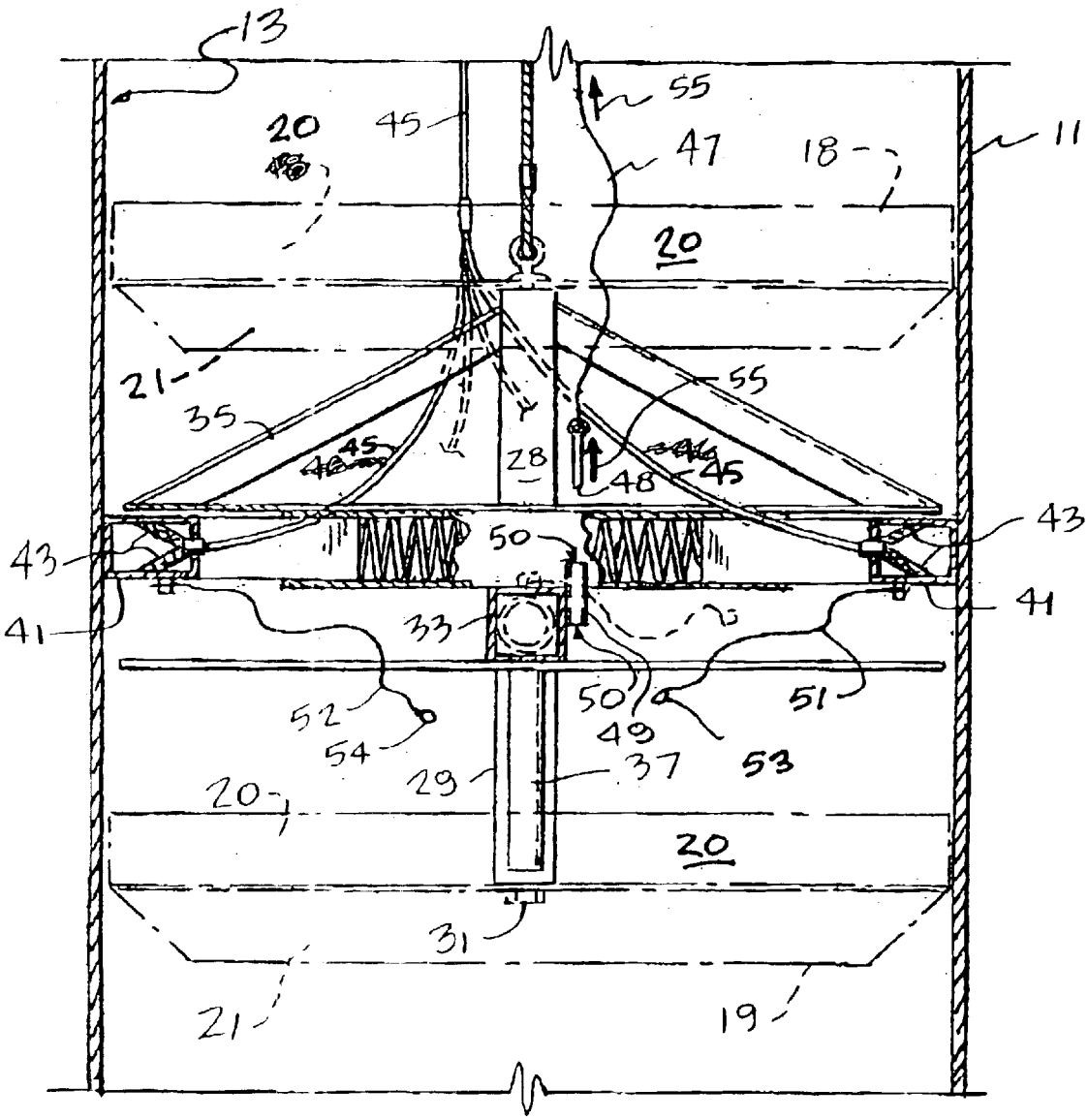
FIG. 3 is a side, partially cut away view of the preferred embodiment of the apparatus of the present invention.
Figure 4:
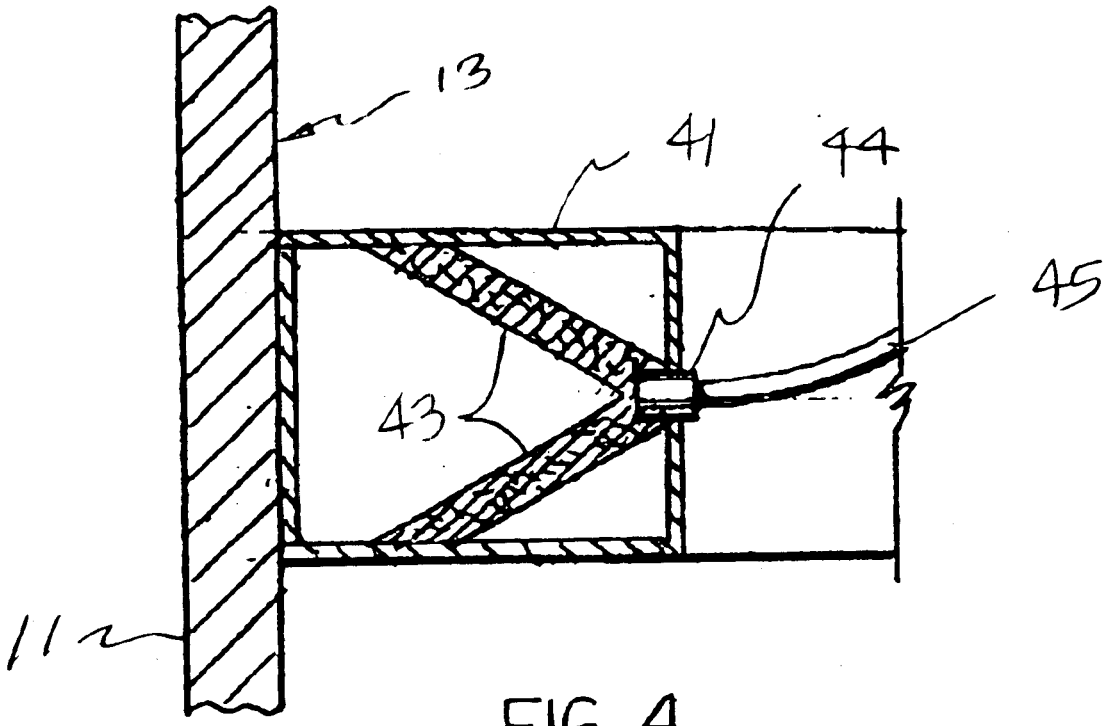
FIG. 4 is a fragmentary elevation view of the preferred embodiment of the apparatus of the present invention.
Figure 5:
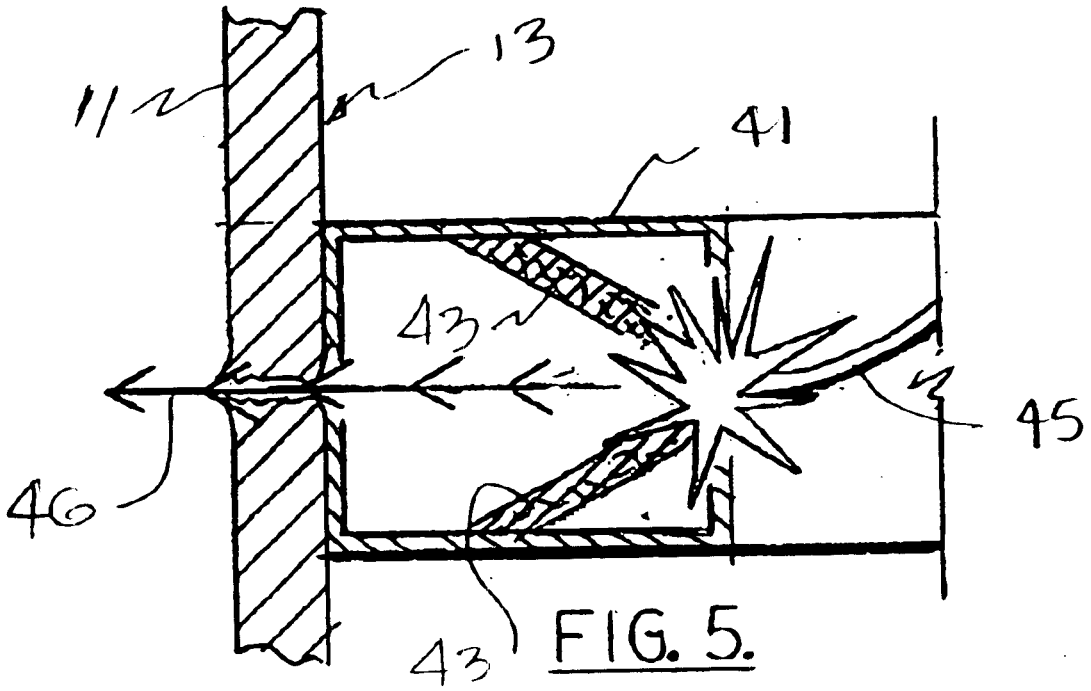
FIG. 5 is a fragmentary elevation view of the preferred embodiment of the apparatus of the invention.

In order to position each of the charge housings 41, 42 in a position against the inner surface 13 of tubular member 11 as shown in FIGS. 4 and 5, trigger pin 48 must be pulled and removed from tube bore 50 of tube 49. In order to fire the trigger pin 48, it must be lifted with lift line 47 in the direction of arrows 55 as shown in FIG. 3.

Each of the charge housings 41, 42 is held in a retracted position, spaced away from the inside surface 13 of tubular member 11 with a plurality of links 51, 52 which can simply be small slings or cables having loops 53, 54 that connect to trigger pin 48 as shown in FIG. 2.

FIG. 2 is the non-firing, retracted position of the charge housings 41, 42. In FIG. 3, the trigger pin 48 is moved upwardly so that the springs 39, 40 can push the charge housings 41, 42 into the engaged, extended position of FIGS. 3, 4 and 5 wherein the charge housings 41, 42 engage the inside surface 13 of tubular member 11. In that position (FIG. 3), the charges 43 can then be fired using detonating cord 45 and boosters 44.

PARTS LIST

| Part Number | Description |
|---|---|
| 10 | underwater explosive apparatus |
| 11 | tubular member |
| 12 | outer surface |
| 13 | inner surface |
| 14 | cable |
| 15 | loop |
| 16 | lifting eye |
| 17 | external threads |
| 18 | upper spacer |
| 19 | lower spacer |
| 20 | cylindrically shaped portion |
| 21 | frustoconical section |
| 22 | horizontal frame |
| 23 | peripheral circular section |
| 24 | radial strut |
| 25 | hub |
| 26 | opening |
| 27 | frame |
| 28 | upper vertical member |
| 29 | lower vertical member |
| 30 | internally threaded opening |
| 31 | bolt |
| 32 | upper horizontal section |
| 33 | lower horizontal section |
| 34 | upper plate |
| 35 | upper diagonal brace |
| 36 | lower plate |
| 37 | lower diagonal brace |
| 38 | transverse plate |
| 39 | upper coil spring |
| 40 | lower coil spring |
| 41 | upper charge housing |
| 42 | lower charge housing |
| 43 | explosive charge |
| 44 | booster |
| 45 | detonating cord |
| 46 | direction of the explosive cutting jet |
| 47 | lift line |
| 48 | trigger pin |
| 49 | tube |
| 50 | tube bore |
| 51 | link |
| 52 | link |
| 53 | loop |
| 54 | loop |
| 55 | arrow |
| 56 | projecting portions |
| 57 | projecting portions |

The foregoing embodiments are presented by way of example only; the scope of the present invention is to be limited only by the following claims.

What is claimed is:

1. A method of severing a tubular member in a marine environment, the tubular member being hollow and having a leg wall with an inside surface, said method comprising the steps of:

a) lowering a frame within the tubular member at a selected location, the frame having multiple curved charges, each being movable between retracted and expanded positions, wherein the charges are retained in a retracted position with a pin in step "a" lowering;

b) moving the charges to the expanded position by removing the pin so that the charges each engage the tubular member;

c) severing the wall of the leg by detonating the explosive charges; and d) wherein in step "b" the charges are spring biased to move to the expanded position responsive to removal of the pin.

2. The method of claim 1 further comprising the step of focusing the charge by shaping the charge at the interface between the tubular member and the frame.

3. The method of claim 1 wherein further comprising the step of remotely activating the frame in step "b" to expand by releasing the spring bias.

4. The method of claim 3 wherein a trigger is mechanically moved to activate the frame to move the charges from the retracted to the expanded position.

5. The method of claim 1 wherein the frame includes multiple curved charge carrier sections and further comprising the step of supporting each explosive charge with a curved section of the frame.

6. The method of claim 1 wherein the charges each include an explosive carried in a curved charge housing.

7. The method of claim 1 further comprising spring loading each charge to move from the retracted to the extended position.

8. The method of claim 7 wherein the frame supports multiple springs.

9. A method of severing a tubular member in a marine environment, the tubular member being hollow and having a leg wall with an inside surface, said method comprising the steps of:

a) lowering a frame within the tubular member at a selected location, the frame having multiple curved charges, each being movable between retracted and expanded positions, wherein the charges are retained in a retracted position with a pin in step "a" lowering;

b) moving the charges to the expanded position by removing the pin so that the charges each engage the tubular member;

c) severing the wall of the leg by detonating the explosive charges;

d) wherein in step "b" the charges are spring biased to move to the expanded position responsive to removal of the pin; and e) wherein the frame includes a central vertical post, and upper and lower horizontal portions attached to the post.

10. A method of severing a tubular member in a marine environment, the tubular member being hollow and having a leg wall with an inside surface, said method comprising the steps of:

a) lowering a frame within the tubular member to be severed and at a selected location on the tubular member, the frame having multiple curved charge housings that are movable between retracted and expanded positions, each charge housing containing an explosive charge wherein the charge housings are held in the retracted position with a removable locking member that is not an explosive device in step "a" lowering;

b) moving the charge housings to the expanded position by removing the locking member so that they each engage the tubular member;

c) severing the wall of the leg by detonating the explosive charges; and d) wherein in step "b" the charges are spring biased to move to the expanded position responsive to removal of the locking member.

11. The method of claim 10 wherein further comprising the step of focusing the charge by shaping the charge at the interface between the tubular member and the frame.

12. The method of claim 10 further comprising the step of remotely activating the frame in step "b" to expand by releasing the spring bias.

13. The method of claim 12 wherein a trigger is mechanically moved to activate the frame to move the charge housings from the retracted to the expanded position.

14. The method of claim 10 wherein the frame includes multiple curved charge carrier sections and further comprising the step of supporting an explosive charge with a curved section of the frame.

15. The method of claim 10 further comprising spring loading each charge housing to move from the retracted to the extended position.

16. The method of claim 15 wherein the frame supports multiple springs.

17. A method of severing a tubular member in a marine environment, the tubular member being hollow and having a leg wall with an inside surface, said method comprising the steps of:

a) lowering a frame within the tubular member to be severed and at a selected location on the tubular member, the frame having multiple curved charge housings that are movable between retracted and expanded positions, each charge housing containing an explosive charge wherein the charge housings are held in the retracted position with a removable member that is not an explosive device in step "a" lowering;

b) moving the charge housings to the expanded position by removing the locking member so that they each engage the tubular member;

c) severing the wall of the leg by detonating the explosive charges;

d) wherein in step "b" the charges are spring biased to move to the expanded position responsive to removal of the locking member; and e) wherein the frame includes a central vertical post, and upper and lower horizontal portions attached to the post.

18. A method of severing a tubular member in a marine environment, the tubular member being hollow and having a leg wall with an inside surface, said method comprising the steps of:

a) lowering a frame within the tubular member to be severed and at a selected location on the tubular member, the frame having multiple curved charge housings that are movable between retracted and expanded positions, each charge housing containing an explosive charge wherein the charge housings are held in the retracted position with a removable member that is not an explosive device in step "a" lowering;

b) moving the charge housings to the expanded position by removing the locking member so that they each engage the tubular member;

c) severing the wall of the leg by detonating the explosive charges;

d) wherein in step "b" the charges are spring biased to move to the expanded position responsive to removal of the locking member; and e) wherein in step "a" the frame has a centering member that engages the tubular member circumferentially to center the frame.

19. A method of severing a tubular member in a marine environment, the tubular member being hollow and having a leg wall with an inside surface, said method comprising the steps of:

a) lowering a frame within the tubular member to be severed and at a selected location on the tubular member, the frame having multiple curved charge housings that are movable between retracted and expanded positions, each charge housing containing an explosive charge wherein the charge housings are held in the retracted position with a removable member that is not an explosive device in step "a" lowering;

b) moving the charge housings to the expanded position by removing the locking member so that they each engage the tubular member;

c) severing the wall of the leg by detonating the explosive charges;

d) wherein in step "b" the charges are spring biased to move to the expanded position responsive to removal of the locking member; and e) wherein in step "a" the frame has a centering member that engages the tubular member circumferentially to center the frame.

20. A method of severing a tubular member in a marine environment, the tubular member being hollow and having a leg wall with an inside surface, said method comprising the steps of:

a) lowering a frame within the tubular member to be severed and at a selected location on the tubular member, the frame having multiple charge housings that are movable between retracted and expanded positions, each charge housing containing an explosive charge wherein the charge housings are retracted in step "a" lowering;

b) holding the charge housings in the retracted position with a locking member that is not an explosive device, c) moving the charge housings to the expanded position by removing the locking member so that they each engage the tubular member;

d) severing the wall of the leg by detonating the explosive charges; and e) wherein in step "c" the charges are spring biased to move to the expanded position.

* * * * *